US007926473B2

(12) United States Patent
Currie et al.

(10) Patent No.: US 7,926,473 B2
(45) Date of Patent: Apr. 19, 2011

(54) AIR SUPPLY SYSTEM FOR AN INTERNAL COMBUSTION ENGINE

(75) Inventors: David Currie, New Hudson, MI (US); Ivan Lazich, Skokie, IL (US)

(73) Assignee: Ford Global Technologies, Dearborn, MI (US)

( * ) Notice: Subject to any disclaimer, the term of this patent is extended or adjusted under 35 U.S.C. 154(b) by 438 days.

(21) Appl. No.: 12/209,423

(22) Filed: Sep. 12, 2008

(65) Prior Publication Data

US 2010/0065029 A1 Mar. 18, 2010

(51) Int. Cl.
*F02B 47/08* (2006.01)
*F02B 29/00* (2006.01)

(52) U.S. Cl. ..... 123/568.17; 123/306; 123/590

(58) Field of Classification Search ..... 123/568.11, 123/568.17, 306, 308, 590; 60/605.2
See application file for complete search history.

(56) References Cited

U.S. PATENT DOCUMENTS

| | | | | |
|---|---|---|---|---|
| 4,327,698 | A | 5/1982 | Hamai et al. | |
| 4,329,843 | A | 5/1982 | Inoue et al. | |
| 4,609,342 | A * | 9/1986 | Showalter | 431/2 |
| 4,879,980 | A | 11/1989 | Piazzo | |
| 4,993,227 | A | 2/1991 | Nagura et al. | |
| 5,207,714 | A | 5/1993 | Hayashi et al. | |
| 5,523,063 | A | 6/1996 | Anderson | |
| 5,765,525 | A * | 6/1998 | Ma | 123/308 |
| 5,924,398 | A * | 7/1999 | Choi | 123/184.21 |
| 6,026,791 | A * | 2/2000 | Arnold | 123/568.27 |
| RE37,269 | E * | 7/2001 | Yamaguchi et al. | 123/308 |
| 6,301,889 | B1 * | 10/2001 | Gladden et al. | 60/605.2 |
| 6,321,715 | B1 * | 11/2001 | Dong | 123/295 |
| 6,470,867 | B2 | 10/2002 | Akiwa et al. | |
| 6,513,506 | B1 | 2/2003 | Ito et al. | |
| 6,672,296 | B2 | 1/2004 | Ito et al. | |
| 6,748,741 | B2 * | 6/2004 | Martin et al. | 60/605.2 |
| 6,776,146 | B1 | 8/2004 | Ricart-Ugaz et al. | |
| 6,889,673 | B2 | 5/2005 | Bender et al. | |
| 7,140,357 | B2 | 11/2006 | Wei et al. | |
| 7,243,641 | B2 | 7/2007 | Zukouski | |
| 7,363,761 | B1 | 4/2008 | Dickerson | |

(Continued)

FOREIGN PATENT DOCUMENTS

JP 8284767 10/1996

OTHER PUBLICATIONS

Arnold, "Single Sequential Turbocharger: A New Boosting Concept for Ultra-Low Emission Diesel Engines," SAE Technical Paper Series, SAE International, Apr. 14-17, 2008 World Congress, Detroit, MI, USA.

*Primary Examiner* — Thomas N Moulis
(74) *Attorney, Agent, or Firm* — Jerome R. Drouillard; Julia Voutyras

(57) ABSTRACT

An air supply system for a reciprocating internal combustion engine includes an air inlet and a mixing volute for receiving charge air from the air inlet. The mixing volute is configured to impart swirl in a first direction to charge air passing from the air inlet and into the volute. An EGR injector introduces exhaust gas into charge air passing through the mixing volute, with the EGR injector being configured to impart swirl in a direction which is opposite to the swirl produced by the mixing volute. This causes the EGR gases and the charge air to become thoroughly mixed within a very short path length through the mixing volute.

11 Claims, 4 Drawing Sheets

U.S. PATENT DOCUMENTS

| | | | | |
|---|---|---|---|---|
| 7,552,722 | B1 * | 6/2009 | Shieh et al. | 123/568.17 |
| 7,721,542 | B2 * | 5/2010 | Chen | 60/605.2 |
| 7,730,878 | B2 * | 6/2010 | Shieh et al. | 123/568.17 |
| 7,743,756 | B2 * | 6/2010 | Styles et al. | 123/568.17 |
| 7,845,340 | B2 * | 12/2010 | Fuchinoue et al. | 123/568.17 |
| 2002/0088443 | A1 | 7/2002 | Marthaler et al. | |
| 2006/0081228 | A1 * | 4/2006 | Keefover et al. | 123/568.23 |
| 2007/0144170 | A1 * | 6/2007 | Griffith | 60/600 |
| 2007/0256413 | A1 * | 11/2007 | Marsal et al. | 60/605.2 |
| 2007/0271920 | A1 * | 11/2007 | Marsal et al. | 60/605.2 |

* cited by examiner

AIR SUPPLY SYSTEM FOR AN INTERNAL COMBUSTION ENGINE

CROSS REFERENCE TO RELATED APPLICATIONS

None.

BACKGROUND OF THE INVENTION

1. Field of the Invention

This disclosure relates to an air inlet system for furnishing charge air, including recirculated exhaust gas, to the cylinders of a reciprocating internal combustion engine.

2. Related Art

Diesel engines, while offering excellent fuel economy, must be controlled ever more stringently in terms of exhaust emissions, particularly oxides of nitrogen ($NO_x$) and particulate matter. In an effort to control $NO_x$ without causing an undue loss in fuel economy, engine designers have relied upon increasingly higher amounts of exhaust gas recirculation (EGR). More specifically, EGR rates of approximately 30% at peak power conditions and 60% at low speed and load are on the horizon. Unfortunately, it is difficult to furnish very high amounts of EGR to an engine's cylinders in a uniform manner. That is, without providing too much EGR to one cylinder while too little to others. Maldistribution of EGR causes an engine to run rough and with unacceptable emissions. Furthermore, this can lead to undesirable temperature nonuniformities in various engine components. Although an extremely lengthy intake tract may be used to provide adequate mixing of EGR with the other components of charge air, a long intake tract may not be package feasible, particularly in vehicular applications.

It would be desirable to provide an inlet system for an internal combustion engine, such as a diesel engine, having the capability of fully mixing large amounts of EGR in a charge air stream so as to prepare a uniform mixture for induction into the engine's power cylinders. It would further be desirable to minimize the package volume required for an engine's air induction system.

BRIEF DESCRIPTION OF THE INVENTION

According to an aspect of the present invention, an air supply system for a reciprocating internal combustion engine includes an air inlet connected to a mixing volute. The mixing volute is configured to impart swirl in a first direction to air passing from the air inlet and through the mixing volute. An EGR injector introduces exhaust gas into air passing through the mixing volute. The EGR injector is configured to impart swirl in a second direction to EGR gases passing through the injector and into charge air flowing through the mixing volute, so that the EGR gases and air will become mixed while traveling through the mixing volute. An intake system conducts mixed air and EGR gases from the mixing volute to one or more power cylinders of the engine.

According to another aspect of the present invention, the EGR injector is located at an axial centerline line of the volute, with the EGR injector including an exhaust gas passage and a flow director, positioned at the discharge end of the exhaust gas passage, and causing EGR gases to be discharged with a swirling motion. The EGR injector causes the swirling motion of the exhaust gases to have a direction of rotation which is opposite the direction or rotation imparted by the mixing volute to charge air flowing through the mixing volute. In this manner, excellent mixing of the air and exhaust gases is achieved.

According to another aspect of the present invention, the mixing volute and EGR injector are located within a common housing containing a charge air compressor inlet duct. In an embodiment, the compressor inlet duct is bifurcated.

It is an advantage of an air supply system according to the present invention that the system is particularly useful for use with V-block engines having relatively shorter induction air flow paths than those typically associated with in-line engines.

It is an advantage of an air induction system according to the present invention that EGR will be introduced not only into the core portion of the air flowing into the engine, but also into the boundary or more remote portions of the flow so as to promote an even distribution of EGR to the engine's cylinders.

It is another advantage of a system according to the present invention that pressure drop on both the EGR and charge air sides of the inducted gases will be minimized.

It is yet another advantage of a system according to the present invention that an engine equipped with this system may be optimized for minimum exhaust emissions because of the more finely regulated and even distribution of EGR to the engine's various cylinders.

It is yet another advantage of the present invention that, as a result of more even EGR flow to each cylinder, the cylinders will develop nearly identical peak pressures, permitting the engine to be calibrated at peak power to take maximum advantage of each cylinder instead of being restricted because of maldistribution of the cylinder pressures.

It is yet another advantage of a system according to the present invention that fuel economy will be improved because of the absence of a need to retard injection timing with a diesel engine to achieve mandated $NO_x$ levels.

It is yet another advantage of a system according to the present invention that the noise, vibration, and harshness (NVH) of an engine will be improved with the present system because even distribution of EGR will prevent discordant sounding combustion.

It is yet another advantage of a system according to the present invention that the package volume of an air induction system having turbocharging and intercooling, particularly in the context of a V-block engine, may be reduced.

Other advantages, as well as features of the present invention, will become apparent to the reader of this specification.

DETAILED DESCRIPTION OF THE PREFERRED EMBODIMENTS

Figure 1:
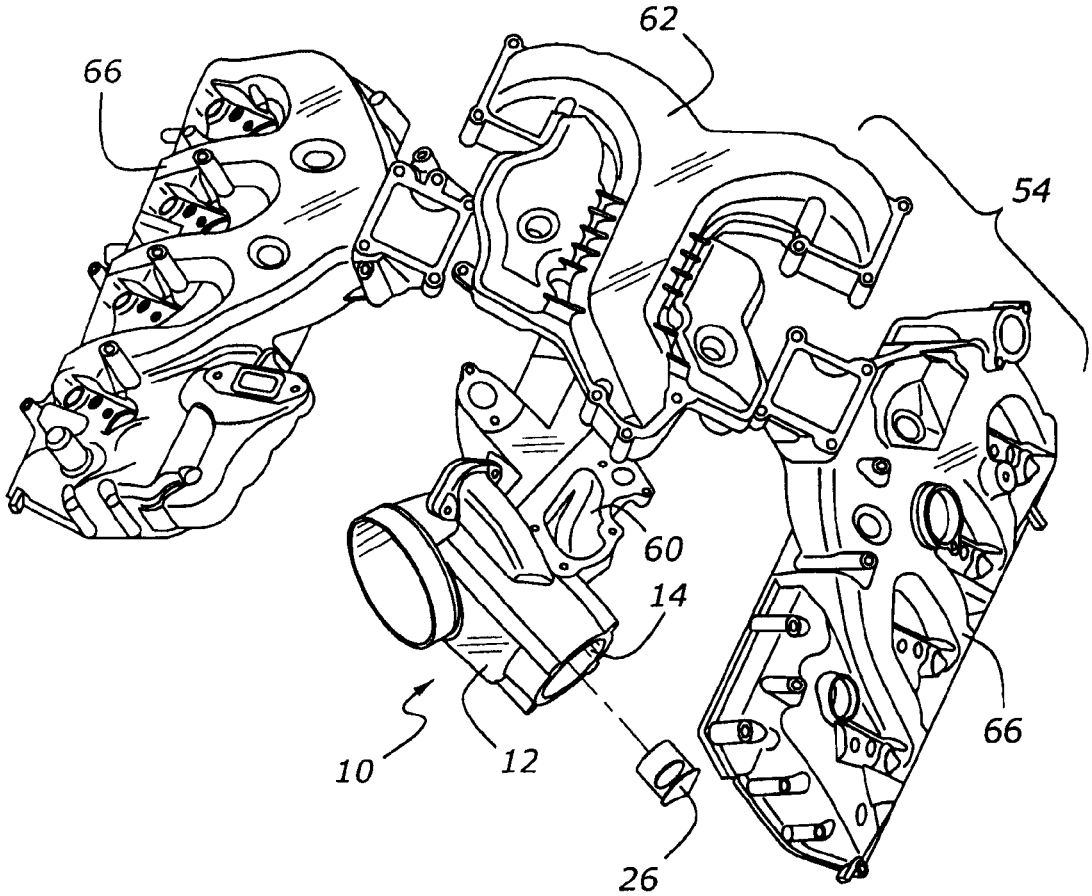
FIG. 1 is an exploded perspective view of a portion of an air inlet system according to an aspect of the present invention.

As shown in FIG. 1, an air intake system for an engine includes a combination turbocharger compressor inlet and EGR mixer, 10, having a compressed air inlet, 14. Charge air discharged through air discharge port 60 of combination compressor inlet and EGR mixer 10 enters upper intake manifold 62 which, taken with combination rocker covers and intake manifolds 66, forms intake system 54.

Details of combination turbocharger compressor inlet and EGR mixer 10 are shown in FIGS. 2-5. As shown in FIGS. 2-5, turbocharger inlet 70 passes under the EGR mixing portion of combination turbocharger compressor inlet and EGR mixer 10. In other words, there is no mixing of air passing through inlet 70 and out through ducts 72A and 72B of combination inlet and mixer 10. The fact that the turbocompressor inlet and EGR mixer are combined allows minimization of the space required by the engine's auxiliaries, which is particularly critical in the valley area of a V-block engine.

Figure 2:
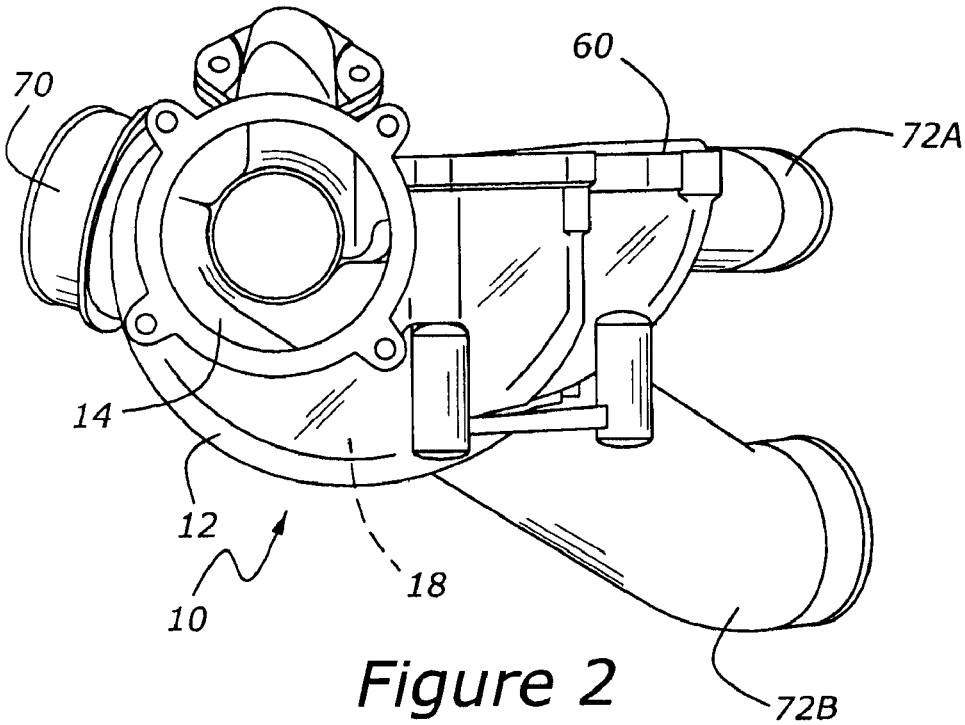
FIG. 2 is a frontal elevation of a combination turbocharger compressor inlet duct and EGR mixer according to an aspect of the present invention.
Figure 3:
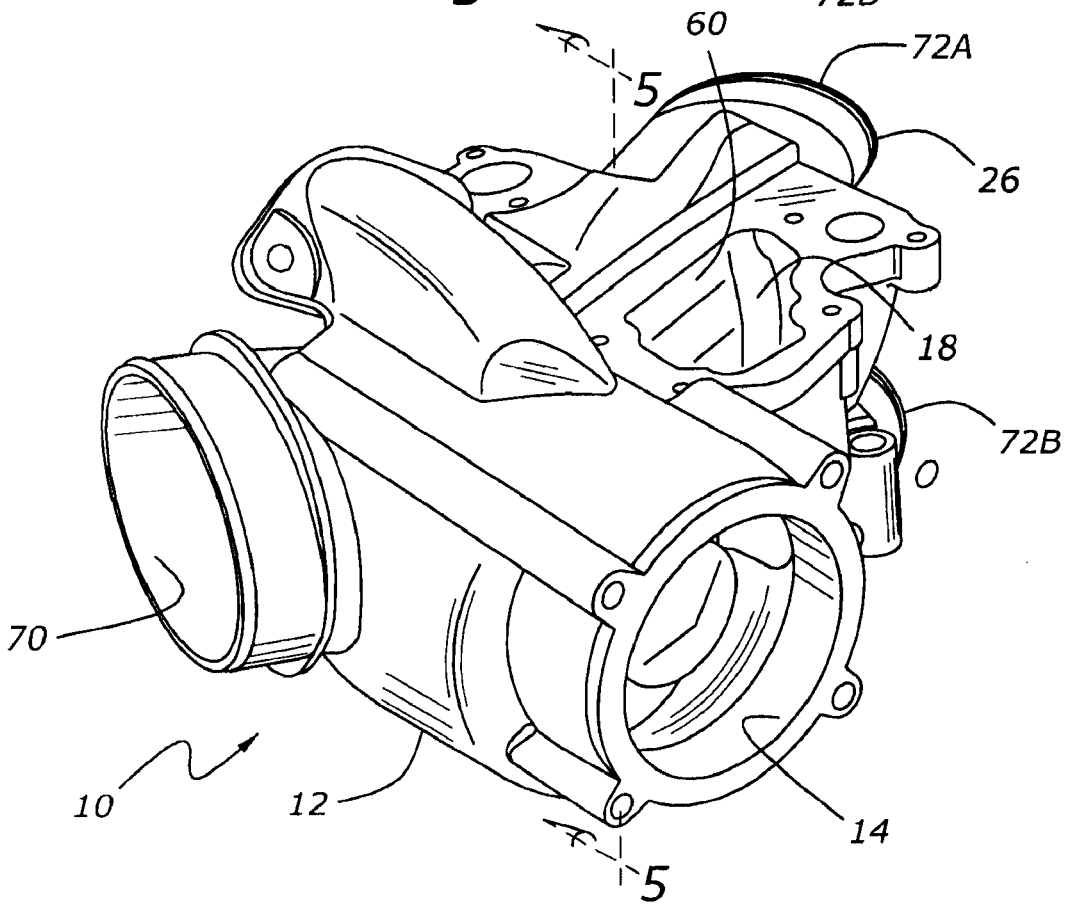
FIG. 3 is a perspective view of the combination inlet duct and EGR mixer shown in FIG. 2.
Figure 4:
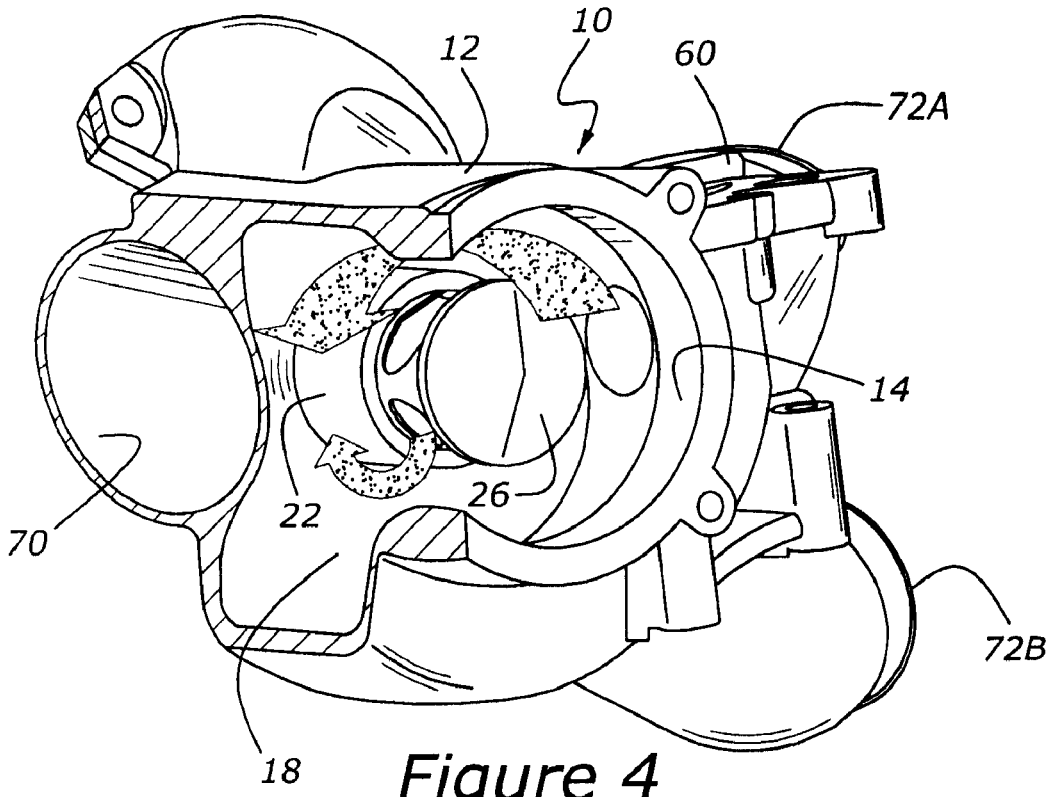
FIG. 4 is a cutaway perspective view of the combination duct and mixer illustrated in FIGS. 2 and 3.
Figure 5:
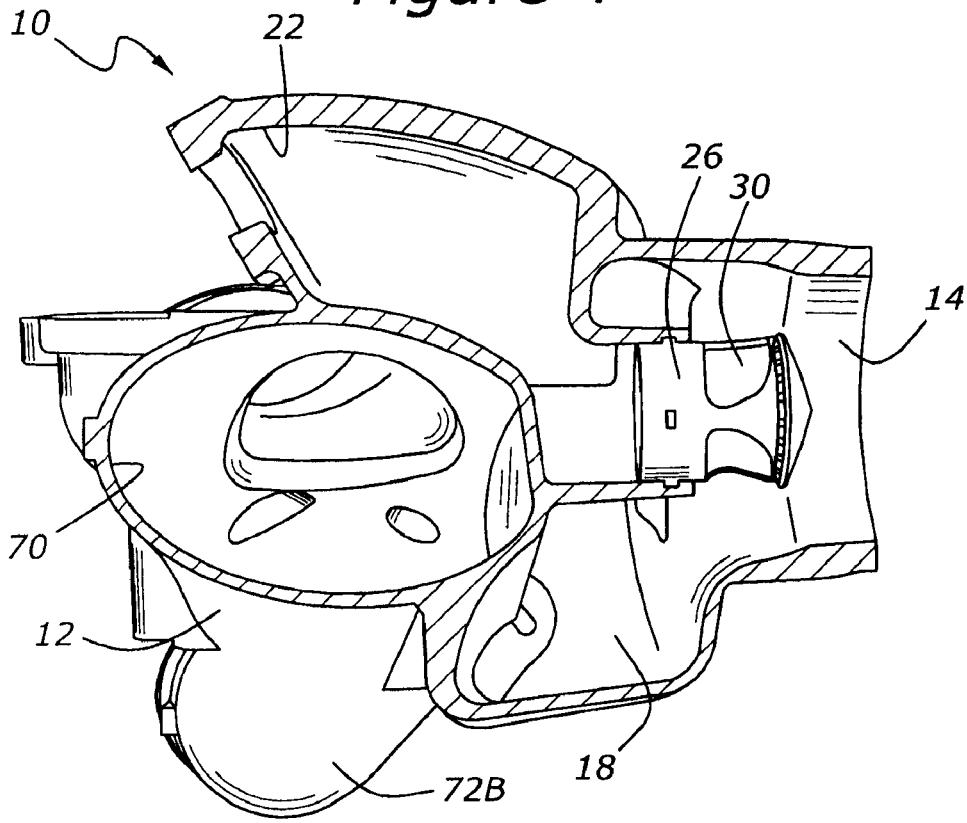
FIG. 5 is a sectional view, partially in elevation, of the combination duct and mixer of FIGS. 2-4 taken along the line 5-5 of FIG. 3.

Although the various figures, particularly FIG. 2, show two outlets for compressor inlet air, namely 72A and 72B, those skilled in the art will appreciate, in view of this disclosure, that the present invention may be practiced with a single outlet.

Figure 6:
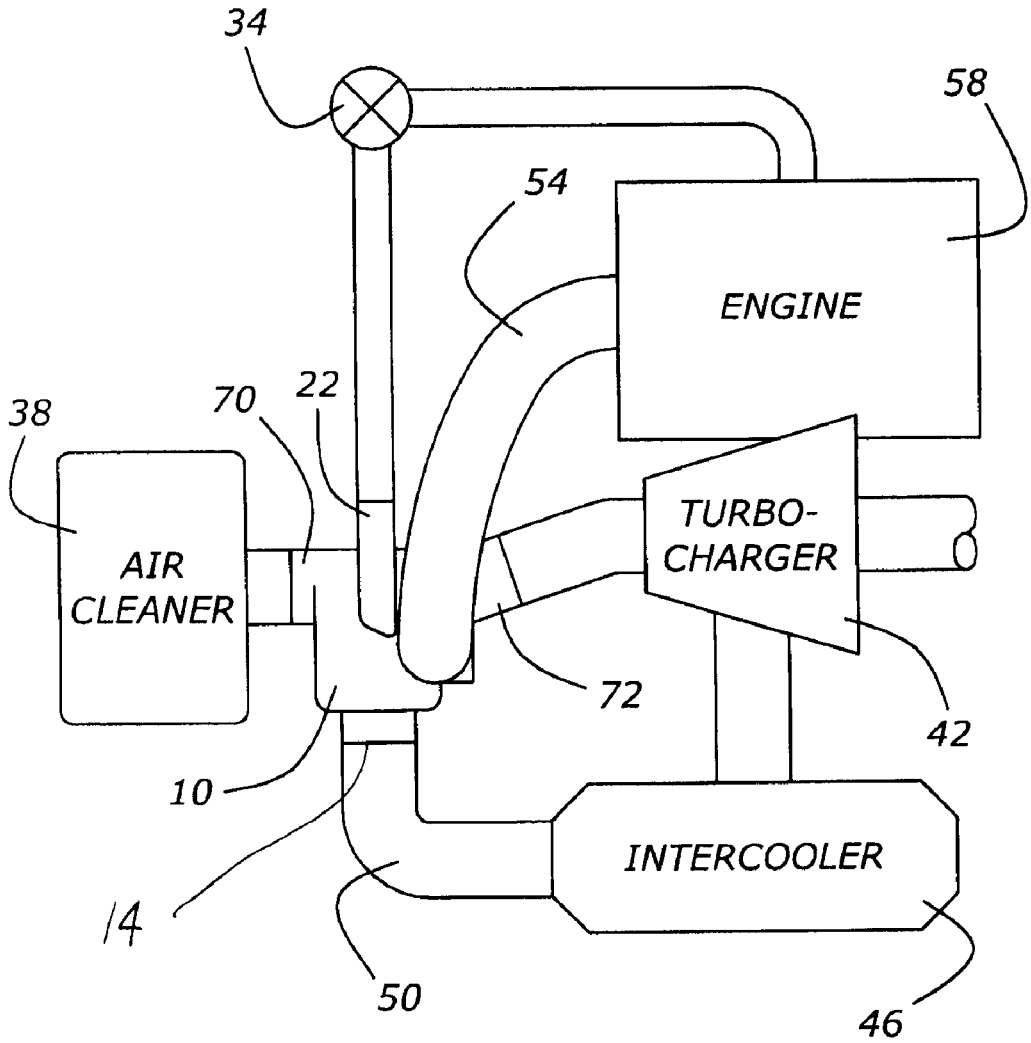
FIG. 6 is a schematic representation of an engine having an air supply system according to an aspect of the present invention.

FIG. 6 bears review at this point, before further discussion is had of the combination inlet and mixer shown in FIGS. 2-5. In FIG. 6, air cleaner 38 is shown as being connected to turbocompressor inlet 70, with turbocharger 42 being connected with duct 72, shown as 72A and 72B in FIGS. 2-5. Turbocharger 42 feeds intercooler 46, which returns air to combination inlet and mixer 10 via supply pipe 50. Engine 58 receives compressed air through intake system 54 (see also FIG. 1). EGR is furnished to mixer 10 by means of EGR valve 34.

With reference once again to FIGS. 2-5, air leaving intercooler 46 through air supply pipe 50 enters the combined compressor inlet and EGR mixer 10 at air inlet 14. Then, the charge air swirls around through mixing volute 18 in a counterclockwise direction which is shown with particularity in FIG. 4. EGR flow, on the other hand, passing through EGR supply passage 22 (FIG. 5) and through EGR flow director 26 receives a clockwise swirl motion by virtue of EGR discharge guide vanes 30, which are incorporated within EGR flow director 26. The EGR flow director is mounted at the axial centerline of volute 18. The counter-rotating swirl motion of the EGR gases with respect to the swirling air flowing through mixing volute 18 produces powerful mixing forces which allow the EGR gases to be fully mixed into the incoming charge air stream within a very short flow path length extending just into upper intake manifold 62. Because the mixing is thorough and complete, it is possible to operate a diesel engine using this system with a high percentage of recirculated exhaust gas while avoiding problems with cylinder-to-cylinder maldistribution of EGR.

According to another aspect of the present invention, a method for supplying charge air to an internal combustion engine includes drawing charge air into a turbocharger compressor, followed by reducing the temperature of compressed air flowing from the compressor by passing the compressed air through an intercooler. The charge air is passed from the intercooler through an EGR mixer, wherein the charge air is caused to swirl in a first direction of rotation through a mixing volute located within the EGR mixer. Exhaust gases are introduced into the EGR mixer. The exhaust gases are introduced into the EGR mixer so as to swirl through the mixing volute in a second direction of rotation, whereby the charge air and the exhaust gases will become mixed. Then the mixed charge air, containing exhaust gas, is introduced to the engine. Optionally, the method further includes passing charge air to the turbocharger compressor through an inlet duct contained within a housing containing the mixing volute.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined by studying the following claims.

What is claimed is:

1. An air supply system for a reciprocating internal combustion engine, comprising:

an air inlet;

a mixing volute for receiving air from the air inlet, with said mixing volute being configured to impart swirl in a first direction to air passing from the air inlet and through the mixing volute;

an EGR injector for introducing exhaust gas into air passing through the mixing volute, with said EGR injector being configured to impart swirl in a second direction to EGR gases passing through the injector and into air flowing through the mixing volute, whereby the EGR gases and said air will become mixed while traveling through the mixing volute; and an intake system for conducting mixed air and EGR gases from said mixing volute to one or more power cylinders of an engine.

2. An air supply system according to claim 1, wherein said EGR injector is located at an axial centerline of said volute, with the EGR injector comprising an exhaust gas passage and a flow director located at the discharge end of the exhaust gas passage for causing EGR gases to be discharged with a swirling motion.

3. An air supply system according to claim 2, wherein the EGR injector causes the exhaust gases to be discharged with a swirling motion having a direction of rotation which is opposite the direction of rotation imparted by the mixing volute to air flowing through the mixing volute.

4. An air supply system according to claim 1, wherein said mixing volute and said EGR injector are located within a housing containing a charge air compressor inlet duct.

5. An air supply system according to claim 4 further comprising a turbocharger and an intercooler positioned between said compressor inlet duct and said air inlet.

6. An air supply system according to claim 4, wherein said compressor inlet duct is bifurcated.

7. An air supply system for a reciprocating internal combustion engine, comprising:

an air cleaner;

a combination turbocharger compressor inlet duct and EGR mixer, with said EGR mixer comprising an air inlet, a mixing volute connected with said air inlet, and an EGR injector for supplying EGR gases to said mixing volute and with an upstream end of said compressor inlet duct being connected with said air cleaner;

a turbocharger connected with a downstream end of the compressor inlet duct;

an intercooler for receiving air from said turbocharger;

a supply pipe for conducting air from said intercooler to said air inlet; and an intake system for conducting air containing EGR gases from said EGR mixer to one or more power cylinders of an engine.

8. An air supply system according to claim 7, wherein said EGR injector imparts counter-rotating swirl motion to EGR gases merging into swirling air flowing through the mixing volute.

9. An air supply system according to claim 7, wherein said intake system is configured to conduct air to opposing cylinder banks of a V-block engine.

10. A method for supplying charge air to an internal combustion engine, comprising:

drawing charge air into a turbocharger compressor;

reducing the temperature of compressed air flowing from the compressor by passing the compressed air through an intercooler;

passing the charge air from the intercooler through an EGR mixer;

causing the charge air to swirl in a first direction of rotation through a mixing volute located within the EGR mixer;

introducing exhaust gases into the EGR mixer;

causing the exhaust gases introduced into the EGR mixer to swirl through the mixing volute in a second direction of rotation, whereby the charge air and the exhaust gases will become mixed; and introducing the mixed charge air, containing exhaust gas to an engine.

11. A method according to claim 10, further comprising passing charge air to the turbocharger compressor through an inlet duct contained within a housing containing said mixing volute.

* * * * *